US005362215A

United States Patent [19]

King

[11] Patent Number: 5,362,215

[45] Date of Patent: Nov. 8, 1994

[54] MODULAR PUMP CYLINDER-HEAD HAVING INTEGRAL OVER-PRESSURE PROTECTION

[75] Inventor: Randall K. King, Duncan, Okla.

[73] Assignee: Halliburton Company, Duncan, Okla.

[21] Appl. No.: 60,112

[22] Filed: May 10, 1993

[51] Int. Cl.[5] ..... F04B 21/00

[52] U.S. Cl. ..... 417/455; 417/454; 417/569; 137/542

[58] Field of Search ..... 417/454, 455, 559, 569, 417/440; 137/540, 542

[56] References Cited

U.S. PATENT DOCUMENTS

| | | | |
|---|---|---|---|
| 1,655,616 | 1/1928 | Larson . | |
| 2,292,294 | 8/1942 | Rotter et al. | 137/542 |
| 2,436,854 | 3/1948 | Corey | 417/569 |
| 2,879,794 | 3/1959 | Costello | 137/542 |
| 3,106,169 | 10/1963 | Prosser et al. | 417/469 |
| 3,363,647 | 1/1968 | Cornelsen et al. | 137/542 |
| 3,373,695 | 3/1968 | Yohpe . | |
| 3,427,988 | 2/1969 | Redman et al. | 417/569 |
| 3,508,849 | 4/1970 | Weber | 417/569 |
| 3,679,332 | 7/1972 | Yohpe . | |
| 3,849,032 | 11/1974 | Mulvey et al. . | |
| 3,998,571 | 12/1976 | Falke . | |
| 4,140,442 | 2/1979 | Mulvey . | |
| 4,508,133 | 4/1985 | Hamid . | |
| 4,520,837 | 6/1985 | Cole et al. . | |
| 4,618,316 | 10/1986 | Elliot | 417/454 |
| 4,768,933 | 9/1988 | Stachowiak . | |
| 4,771,801 | 9/1988 | Crump et al. . | |
| 5,073,096 | 12/1991 | King et al. . | |

FOREIGN PATENT DOCUMENTS 2403588 7/1975 Germany ..... 417/454

*Primary Examiner*—Richard A. Bertsch
*Assistant Examiner*—M. Kocharov
*Attorney, Agent, or Firm*—Stephen R. Christian

[57] ABSTRACT

A modular fluid end assembly, and associated method of providing same, for a reciprocating pump having a cylinder housing secured to a crankcase by tie bolts. The fluid end is tolerant to having cylinder-head bolts improperly torqued while also providing an over pressure relief feature. The modular fluid end includes a cylinder-head having two seal landings, one common to a cylinder base joint surface and one common to an end joint surface. The base joint seal landing is smaller than the end joint seal landing. An end plate and a co-acting valve cover is provided. The valve cover includes a seal extending thereabout and is accommodated by the seal landing of the end joint. A second seal is accommodated by the base joint seal landing. A plurality of cylinder-head bolts having predetermined yield strengths, are located in proximity to the periphery of the end plate to force the end plate and the valve cover against the cylinder-head. Upon an over-pressure condition, the bolts yield thereby allowing the end plate to move away from the cylinder-head and the larger end joint seal ruptures prior to the base joint seal, thereby allowing the fluid or slurry being pumped to flow between the end plate and the cylinder-head thereby preventing damage to the more difficult to repair cylinder housing, while protecting expensive power-end components from being damaged by the overload condition.

14 Claims, 2 Drawing Sheets

MODULAR PUMP CYLINDER-HEAD HAVING INTEGRAL OVER-PRESSURE PROTECTION

FIELD OF THE INVENTION

This invention relates generally to high-pressure reciprocating pumps, and more particularly to plunger, or piston, type pumps commonly used in the oil and gas production industry.

BACKGROUND OF THE INVENTION

High-pressure pumps having reciprocating plungers, or pistons, are frequently used in oil and gas production fields for cementing, acidizing, fracturing, and other treatments of wells to enhance or restore the production rate thereof. Such pumps are routinely called upon to pump two-phase slurries down the well bore at high pressures. The term, two-phase slurries, refers to a liquid-solid mixture having a preselected amount of solid particles suspended in a liquid, such as sand and water.

The fluid, or slurry, is compressed in what is referred to as the fluid-end of the reciprocating pump which generally includes a cylinder head having an intake valve and a discharge valve. A piston, or plunger, reciprocates in a cylinder that is attached to the cylinder head thereby compressing the fluid or slurry. The pressurized liquid, or slurry, is then allowed to exit the pump through the discharge valve whereupon it is guided into the well-bore. The operating pressures of the fluid end of such a reciprocating pump often reach pressures exceeding 10,000 lbs/in$^2$ (700 kg/cm$^2$). Should a leak occur in the cylinder-head and/or cylinder housing passages in the fluid end of the pump, the highly abrasive nature of two-phase slurries under such pressures, quickly erodes the fluid end body causing a multitude of problems. Namely, system pressure loss, spillage of the slurry about the location of the pumping equipment, and costly down time of the pumping equipment when it is either repaired or replaced. Costs associated with down pumping equipment include the repair costs of the pump, the cost of which depends on whether the pump is repaired in the field or shipped to a repair facility, the idle time of the crews needed to perform the treatment, and the loss of production revenue generated by the oil or gas well being treated.

One means of combatting such cylinder-head leaks is to attach the cylinder-head to the cylinder and/or the crankcase by bolts, or studs, that are tightened to preselected torques to induce a relatively high preload thereon. Such an arrangement is shown in U.S. Pat. No. 3,373,695—Yohpe which relates to reciprocating pumps and is representative of the prior art. FIG. 1 herein, is a reproduction of FIG. 3 of Yohpe '695, which depicts a discharge manifold 21 having wall member 45 and cover 46 being secured to cylinder block 29 by co-acting studs 48 and nuts 47. FIG. 2 herein, is a reproduction of FIG. 4 of Yohpe '695 which shows an alternative fluid end assembly having cover 46 directly secured to block 29 by studs 48 having nuts 47 threaded thereon.

A problem inherent with the prior art arrangements is that relatively large diameter bolts, or studs, are required that can withstand the high cyclic tensile loads induced by the plunger compressing the fluid within the fluid end of the pump. Furthermore, the bolts, or studs, must be accurately tightened to prescribed torques to induce a relatively high preload on the bolts, or studs. Consequently, if a cylinder-head is removed in the field for repairs to be performed on the pump, it is very probable that the bolts, or studs, retaining the cylinder-head will not be re-tightened accurately. That is, the bolts or studs are likely to be under or over tightened by those making the repairs in, more often than not, harsh field conditions. Such improper tightening can result in further seal failure with all of the associated problems previously mentioned. Thus, there is a long standing need to provide a pump fluid end for reciprocating pumps that provides a cylinder-to-head seal that is less sensitive to having cylinder-head bolts or studs being improperly tightened without jeopardizing the integrity of the seal arrangement between the cylinder-head and the cylinder housing.

Furthermore, the usage of overly large diameter bolts can result in design limitations in the cylinder head, or block, and the mating cylinder due to size considerations.

Another enduring problem within the industry is that the solid particle portion of the slurry, under certain operating parameters, can become packed in the fluid end of the pump resulting in an over-pressure situation that can be extremely damaging to certain structures within the pump, including for example, the cylinder-head structure, the piston or plunger, as well as the connecting rod and crankshaft assembly.

A variety of solutions to prevent over-pressure induced damage to pumps have been devised. One such solution is taught in U.S. Pat. No. 5,073,096—King et al. assigned to the assignee of the present invention. The '096 King et al. patent discloses a front-discharge fluid end for a reciprocating pump wherein a fluid outlet valve is positioned co-axially with the plunger assembly of the pump. Thus, the pump disclosed in the '096 patent allows solid particles that have precipitated out of the two-phase slurry within the pump to be nonetheless discharged through the outlet valve preventing over-pressure induced damage to the pump. Notwithstanding the solution disclosed in the '096 King et al. patent, there remains a need in the art for a pump fluid end assembly and associated method that provides yet further protection of the structure and components of a reciprocating pump should an over-pressure condition arise.

SUMMARY OF THE INVENTION

It is an object of the present invention to provide a pump fluid end assembly and associated method that provides relief for over-pressure conditions that may occur when pumping two phase slurries with a reciprocating pump.

Another object of the present invention is to provide a pump fluid end that is less sensitive to having cylinder head bolts, or studs, improperly tightened as compared to prior art pump fluid ends.

A further object of the present invention is to provide a pump fluid end in which seals can easily be replaced in the field by service crews often working in harsh environments.

The present invention includes a modular fluid end assembly designed for a reciprocating plunger pump having a cylinder housing secured to a crankcase by tie bolts. The modular fluid end includes a cylinder-head having a head-to-cylinder base joint surface and an oppositely positioned end joint surface. The base joint surface of the cylinder-head has a bore therethrough and an annular seal landing located about the bore between the cylinder-head and the cylinder housing. The seal landing has a preselected internal diameter. The end joint surface of the cylinder-head further includes a bore in communication with the bore in the base joint surface of the cylinder-head when a discharge valve located in the fluid end is open. The bore has an end seal landing common to the end joint surface and the end seal landing has a preselected internal diameter and is preferably recessed. A seal means is positioned within the seal landing of the end joint surface. An end plate having an outer surface, an end joint surface, and a threaded bore extending through the end plate perpendicular to the end joint surface is provided. A valve cover having an inner face, an outer face and an outer periphery having a seal means extending thereabout is also provided. The outer periphery of the cover and the associated seal is sized to be accommodated by the end seal landing of the cylinder-head. A valve cover retaining ring having a valve cover mating face and a threaded outer periphery configured to engage the threaded bore of the end plate is further provided. Lastly, in the preferred embodiment, a plurality of cylinder-head bolts are located about the periphery of the end plate which pass through the outer surface of the end plate, end joint surface of the cylinder-head, and the base joint surface of the cylinder-head and are ultimately secured to the cylinder housing.

Additional objects and advantages of the present invention will become apparent after reviewing the following detailed description of the preferred embodiment shown in the drawings.

DETAILED DESCRIPTION OF THE PREFERRED EMBODIMENT

Figure 1:
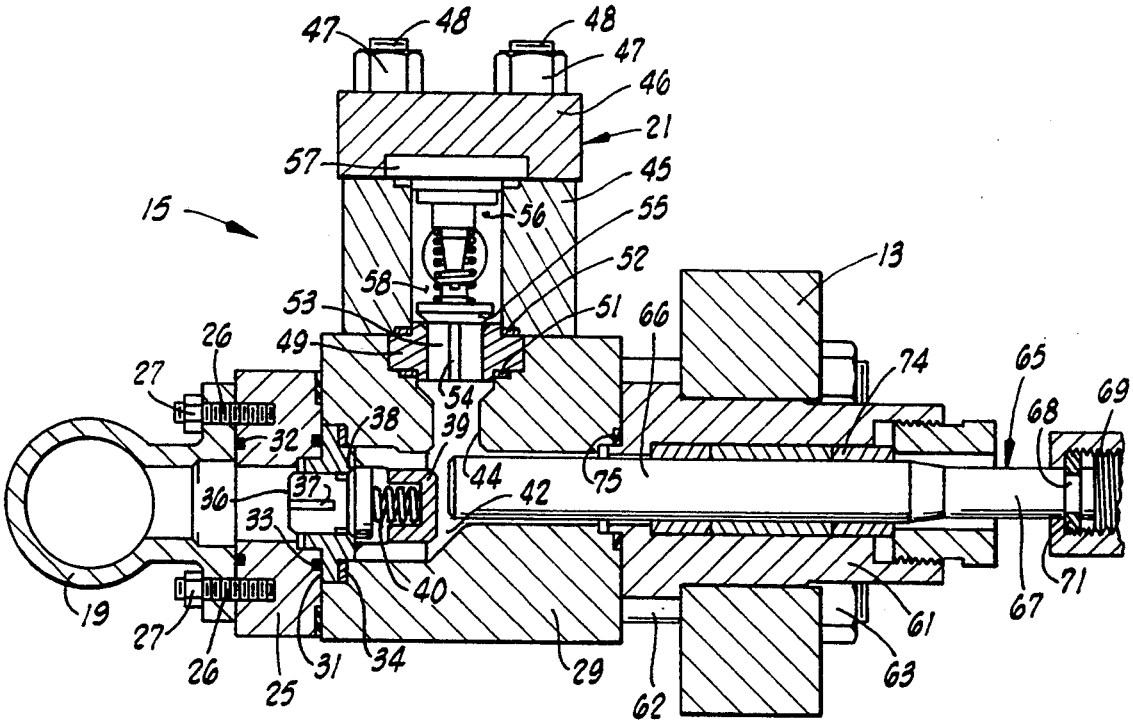
FIG. 1 PRIOR ART
FIG. 1 is a cross-sectional view of a representative prior art reciprocating pump fluid end as disclosed in FIG. 3 of U.S. Pat. No. 3,373,695.
Figure 2:
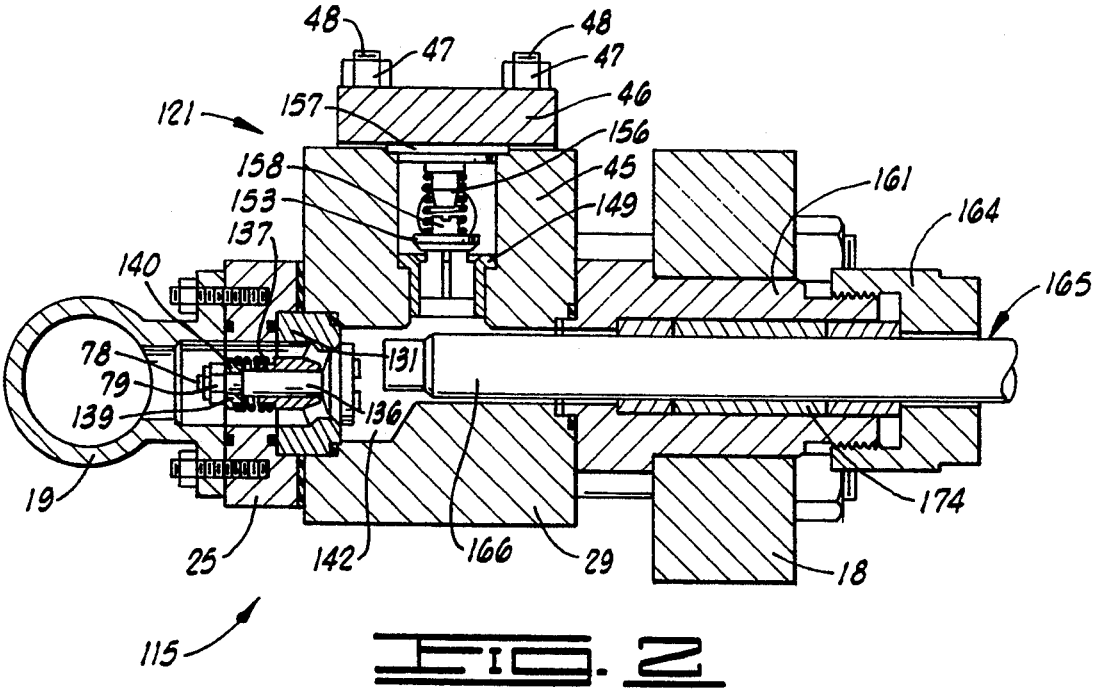
FIG. 2 PRIOR ART
FIG. 2 is a cross-sectional view of a representative prior art reciprocating pump fluid end as disclosed in FIG. 4 of U.S. Pat. No. 3,373,695.
Figure 3:
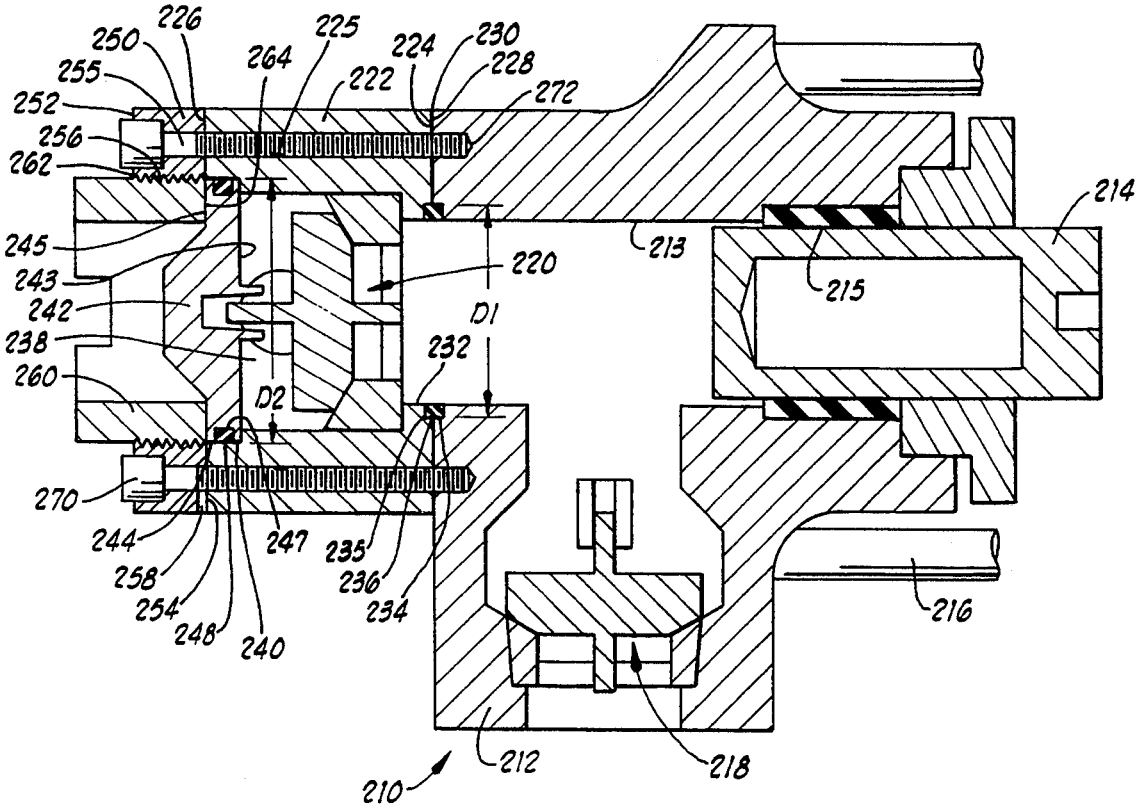
FIG. 3 is a cross-sectional view of the disclosed modular fluid end for a reciprocating pump.

Referring now to FIG. 3 of the drawings, the preferred embodiment of the disclosed modular fluid end for a reciprocating pump is shown in a horizontal cross-sectional view and is generally referred to by numeral 210.

Modular fluid end 210 includes a cylinder housing 212 having a plunger bore 213 therein. A plunger, or piston, 214 is disposed within bore 213 and reciprocates therein. Plunger packing means 215 provides a seal between plunger 214 and bore 213 to prevent migration of fluids between the plunger and bore consistent with the practice of the art. A pump may have more than one such plunger and bore combination in a fluid end assembly. For example, a fluid end having a cylinder housing having a horizontal row of three bores with a respective plunger in each bore being connected to a common crankshaft is not uncommon within the art and the fluid end assembly disclosed herein is suitable for such multi-plunger pumps as well.

Cylinder housing 212 is secured to a crankcase (not shown) by a plurality of bolts, or studs, 216. These bolts, or studs, are often referred to as tie-bolts and such an arrangement is routinely practiced within the art.

Intake valve assembly 218, is in fluid communication with plunger bore 213 and is preferably positioned approximately 90°, or perpendicular, thereto. Discharge valve assembly 220 is shown located within cylinder-head block 222 and is positioned coaxially with respect to plunger bore 213. Such an arrangement is referred to within the field of art as a T-bore type pump fluid end.

Cylinder housing 212 has a base joint surface 224 and cylinder-head 222 has a head-to-cylinder base joint surface 228 which when assembled to cylinder head 222, forms a head-to cylinder base joint 230. The opposite end of cylinder head 222 has an end joint surface 226.

Base joint surface 228 of cylinder-head 222 includes a bore 232 leading into cylinder housing 212, which in the preferred embodiment has the same internal diameter of plunger bore 213 of cylinder housing 212. Both, bores 213 and 232, are shown having matching recessed seal landings 234 and 235, respectively, for accommodating a seal means 236 for sealing head-to-cylinder base joint 230. Matching landings 234 and 235 have identical, or nearly identical predetermined diameters, shown as D1 in FIG. 3, and it is preferred that seal means 236 be a face, or sandwich type seal, as opposed to a radial type seal. However, a radial type seal could be employed if desired. Both face, or sandwich, and radial type seals are well known within the pump industry and can be readily obtained from a variety of commercial sources.

Figure 4A:
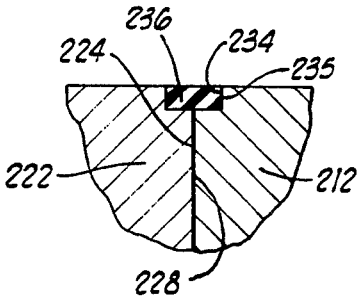
FIG. 4A is a broken away cross-sectional view of matched seal landings 234 and 235 containing seal 236.
Figure 4B:
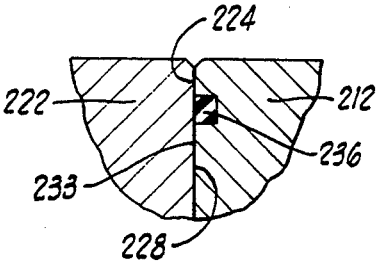
FIG. 4B is a broken away cross-sectional view of a single seal landing 233 located in cylinder housing 212 containing seal 236 in lieu of matched seal landings 234 and 235.
Figure 4C:
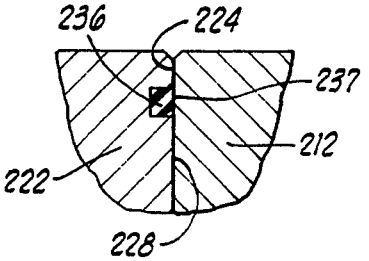
FIG. 4C is a broken away cross-sectional view of a single seal landing 237 located in cylinder housing 212 containing seal 236 in lieu of matched seal landings 234 and 235.

Matching seal landings 234 and 235 as shown in FIG. 3 and as shown in the broken away cross-section of FIG. 4A, can readily be replaced by a single seal landing located in either base joint surface 228 of cylinder head 222, shown as single landing 233 in FIG. 4B, or in base joint surface 224 of cylinder-head block 212, shown as single landing 237 in FIG. 4C. By employing either such single landing with a suitable seal means 236 therein, the machining costs of providing matched seal landings are reduced and the costs associated with the need to accurately align bores 232 and 213 with each other to ensure proper sealing therebetween are reduced as well.

Cylinder-head 222 further includes a bore 238 having a recessed seal landing region 240 communicative with end joint/vent region 258. Landing region 240 has a predetermined diameter, shown as D2, and is in fluid communication with bore 232 upon valve assembly 220 being in the open position.

A valve cover 242 having an outer periphery 244, is disposed within bore 240 of cylinder-head housing 222. Valve cover 242 is provided with an inner face 243, which faces toward valve 220, and is also provided with an outer face 245, which faces away from valve 220. Outer periphery 244 includes a recessed seal landing 247 for accommodating a seal means 248. Seal means 248 is preferably a radial-type seal, as opposed to a face, or sandwich, type seal.

An end plate 250 having an outer surface 252, an end joint surface 254, a plurality of bolt holes 255, and a threaded bore 256 extending through the center of the plate for each cylinder is provided for receiving a cylinder-head retainer 260 having an external threaded periphery 262. Upon retainer 260 being threadingly engaged with threaded bore 256 of end plate 250, valve cover facing 264 engages with valve cover 242 which in turn engages cylinder head 222. End plate 250 fits generally flush against cylinder head 222. However, upon an over pressure condition occurring within plunger bore 213 and bores 232 and 238, end plate 250 will move coaxially away from cylinder-head 222 due to elongation of bolts 270thereby forming a slight gap or vent 258 between end plate 250 and end joint surface 226 of cylinder-head 222 for drainage purposes. This aspect of the invention will be further discussed herein. Bolts 270 are positioned about the periphery of end plate 250 and pass through bolt holes 255 and through bolt holes 225 of cylinder-head block 222 and attach to cylinder housing 212 by way of threaded bore 272. Bolts 270, in the alternative, could be studs having a nut on the end thereof, or in another alternative, the bolts, or studs, can be secured to cylinder housing 212 by way of a flange or other such means.

Preferably, diameter D1 of the adjoining base joint seal landings 234 and 235 is less than the inside diameter D2 of the recessed seal landing region 240 adjoining end joint surface 26 of cylinder-head block 222.

OPERATION OF THE INVENTION

During a normal operating cycle, fluid or two phase slurry is introduced to bore 213 by way of intake valve 218 upon plunger 214 receding away from the fluid end 210 of the pump. Upon plunger 214 reversing direction at the bottom of its stroke, the intake valve closes and the fluid or slurry present within the fluid end is compressed as the plunger advances toward the end of cylinder housing 212 whereupon at a preselected internal pressure, discharge valve 220 which is held closed on the suction stroke by a spring opens and the compressed fluid or slurry is forced through valve 220 and outward into a discharge manifold. The intake and discharge cycles are rapidly repeated until a sufficient amount of fluid, or slurry, has been pumped into a well-bore to a pressure that has been specified for the particular treatment being undertaken.

By providing a fluid end having the features disclosed herein, bolts 270 need not be as large as conventional cylinder head bolts due to the absence of cyclic tensile forces being imparted on bolts 270 under normal operating pressures. For instance, the pressure in bore 238 of cylinder-head 220 is going to be greater than the pressure in bore 213 of the cylinder housing when the plunger is traveling away from the cylinder-head, and the pressure in bore 238 of cylinder-head 220 is going to be nearly equal to the pressure in bore 213 of the cylinder housing when plunger 214 is traveling towards cylinder-head 222 causing valve 220 to open. Despite the pressure differences between the bores during the operation of the pump, bolts 270 are not cyclically loaded due to the pressure in bore 238 attempting to push valve cover 242 axially outward, which in turn, is restrained from motion by retainer 260 co-acting with end plate 250 and bolts 270, regardless of whether discharge valve 220 is open or closed. The load in bolts 270 is produced by discharge pressure in bore 238 acting on cover 242, in which the load remains nearly constant whether plunger 214 is on a suction stroke or a discharge stroke.

Thus, bolts 270 normally experience a gradually increasing tensile load as discharge pressure builds to a maximum value within bore 238 during a treatment operation. On the plunger side of discharge valve 220, when the pressure in bore 213 is at a maximum value, bolts 270 still do not experience a cyclic load because the pressure differential between bore 238 and bore 213 is negligible. This desirable attribute is due to diameter D1 being less than diameter D2 and due to the cylinder-head block having the valve cover, end plate, and cylinder-head being secured as disclosed and described herein.

If during a pumping procedure an over-pressure condition should develop within fluid end 210 for any given reason, such as sand, or other solid particles, precipitating out of the slurry and collecting in bore 213 instead of being discharged through discharge valve 220 in the regular manner, disclosed fluid end 210 will provide for the relief of the over-pressure condition with a minimum amount of structural damage, if any, to the pump. Such over pressure protection is achieved by selecting bolts 270 which have a combined yield strength corresponding to a predetermined maximum safe operating pressure that is desired to occur in bore 213 of cylinder housing 212. By so selecting the combined yield strength of bolts 270 such that when an over pressure condition occurs, bolts 270 elongate, thereby allowing the fluid or slurry upon reaching the preselected maximum safe pressure within bore 213, and consequently bore 238, to rupture seal 248 thereby providing pressure relief. The rupture of seal 248 will occur prior to the rupture of seal 236 because seal landings 234 and 235, or alternative seal landings 233 or 237, have a preselected diameter D1 that is less than diameter D2 of seal landing 240. This difference in diameters causes landing region 240 to be exposed to greater pressure induced radial forces during the operation of the pump which in turn ruptures seal 248 before seal 236. Furthermore, end joint/vent region 258, opens to form a slight gap between end plate 250 and end joint surface 226 of cylinder-head 222 due to the elongation of bolts 270 and thus facilitates the drainage of liquid, or slurry, therethrough. Thus, even in the event of prolonged operation of a pump having a ruptured seal 248, end plate 250 and cylinder-head 222 are structures that are easily replaced in the field, as compared to repairing damage to base joint 224 of cylinder housing 212. This particular feature can be quite beneficial if the rupture of seal 248 is not noticed in a timely manner, or is ignored over a significant period of time.

Although the disclosed invention has been shown and described with respect to the preferred embodiment thereof, it will be understood by those skilled in the art that various changes in the form and detail thereof may be made without departing from the spirit and scope of this invention as claimed.

What is claimed is:

1. A modular fluid end assembly for a reciprocating pump having a cylinder housing secured to a crankcase, the modular fluid end comprising:

a cylinder-head having a cylinder-head to cylinder housing base joint surface and an oppositely positioned end joint surface;

the base joint surface of the cylinder-head having a first bore therethrough and an annular base seal landing having a preselected nominal diameter;

the end joint surface of the cylinder-head having a second bore in communication with the first bore in the base joint surface of the cylinder-head, the second bore having an end seal landing region common to the end joint surface, the end landing region having a nominal preselected diameter that is greater than the preselected nominal diameter of the base seal landing;

a first seal means positioned in the seal landing of the base joint surface;

an end plate having an outer surface, an end joint surface, and a threaded bore extending through the end plate perpendicular to the end joint surface;

a valve cover having an inner face, an outer face, and an outer periphery having a second seal means extending thereabout, the outer periphery and the second seal means sized to be accommodated by the landing region common to the end joint surface of the cylinder-head;

a valve cover retainer having a valve cover engaging face and an outer periphery configured to security engage the bore of the end plate; and a plurality of cylinder-head bolts located in proximity to the periphery of the end plate, the bolts passing through the end joint surface and the base joint surface of the cylinder-head and being received by the cylinder housing.

2. The fluid end assembly of claim 1 wherein the cylinder housing is secured to the crankcase by tie-bolts and the cylinder-head bolts are subject to yielding prior to the tie bolts upon the fluid end of the pump obtaining a preselected internal pressure.

3. The fluid end assembly of claim 1 wherein the second seal means positioned about the periphery of the valve cover is a radial seal and is accommodated by the end seal landing region of the end joint surface.

4. The fluid end assembly of claim 1 further comprising:

the cylinder-head having a discharge valve being in coaxial alignment with the plunger; and the cylinder housing having an intake valve assembly located therein at an approximately 90° angle with respect to the discharge valve thereby forming a T-bore type fluid end.

5. The fluid end assembly of claim 1 wherein the end joint surface is configured to have an end joint vent region means in communication with the end seal landing for the venting of liquid or slurry upon the elongation of the cylinder-head bolts and rupturing of the radial seal located in the seal landing of the end joint surface.

6. A modular fluid end assembly for a reciprocating pump having a cylinder housing secured to a crankcase by the tie-bolts having a predetermined yield strength, the modular fluid end comprising:

a cylinder-head having a head-to-cylinder base joint surface and an oppositely positioned end joint surface;

a discharge valve assembly being positioned in the cylinder-head in coaxial alignment with a plunger located in the cylinder housing;

an intake valve assembly located int he cylinder housing at approximately a 90° angle from the discharge valve assembly;

the base joint surface of the cylinder-head having a bore therethrough;

a first seal landing proximate to the bore and in communication with the base joint surface, the seal landing having a preselected internal diameter;

a first radial seal located in the first seal landing for providing a seal between the cylinder-head and the cylinder housing;

the end joint surface of the cylinder-head having a second bore in communication with the first bore in the base joint surface of the cylinder-head, the bore having a second seal landing region common to the end joint surface, the second seal landing having an internal diameter which is larger than the internal diameter of the first seal landing of the base joint;

a second radial seal positioned within the second seal landing of the end joint surface;

an end plate having an outer surface, an end joint surface, and a threaded bore extending through the end plate perpendicular to the end joint surface;

a valve cover having an inner face, an outer face, and an outer periphery having a seal means extending thereabout, the outer periphery and the seal sized to be accommodated by the second end seal landing of the cylinder-head;

a cylinder-head cover retainer having a valve cover facing and a threaded outer periphery configured to engage the threaded bore of the end plate;

a plurality of cylinder-head bolts located about the periphery of the end plate, the bolts passing through the outer surface of the end plate, the end joint surface of the cylinder-head, and the base joint surface of the cylinder-head and the bolts being received by the cylinder housing; and wherein the cylinder-head bolts are subject to yielding prior to the tie bolts upon the fluid end of the pump obtaining a preselected internal pressure.

7. A modular fluid end assembly for a reciprocating pump having a cylinder housing secured to a crankcase by tie-bolts having a preselected yield strength, the modular fluid end comprising:

a cylinder-head having a head-to-cylinder base joint surface and an oppositely positioned end joint surface;

a first cavity extending into the cylinder-head from the base joint surface;

a base joint seal landing common to the first cavity and the base joint surface, the seal landing having a preselected nominal internal diameter;

a second cavity in communication with the first cavity, the second cavity having a bore of a preselected nominal internal diameter;

a first seal means positioned in the base joint seal landing;

an end plate having an end joint surface positioned against the end joint surface of the cylinder-head;

a valve cover positioned against the end joint surface of the cylinder-head to cover the second cavity of the cylinder-head;

a second seal means positioned between the valve cover and the bore of the second cavity of the cylinder-head;

an end joint/vent region located between the end plate and the end joint surface of the cylinder-head; and fastener means for forcing the end plate, and hence the valve cover, towards the cylinder-head to induce a predetermined minimum preload upon the fastener means and the fastener means is configured and constructed of a material having a predetermined yield strength which corresponds to a predetermined maximum operating pressure of the pump whereupon the fastener means yields prior to the tie-bolts yielding to provide internal pressure relief of the pump should an over pressure condition occur.

8. The modular fluid end assembly of claim 7 wherein the nominal diameter of the base joint seal landing is less than the nominal diameter of the second cavity in the cylinder-head.

9. The modular fluid end assembly of claim 7 wherein the fluid end assembly is of a T-bore type arrangement.

10. The fluid end assembly of claim 7 wherein a separate fluid end assembly is provided for each plunger or piston located in a common cylinder housing having more than one such plunger or piston located in respective bores therein.

11. A method of providing over-pressure protection of a fluid end assembly for a reciprocating pump having a cylinder housing secured to a crankcase by tie-bolts having a preselected yield strength, the method comprising:

providing a cylinder-head having a head-to-cylinder base joint surface and an oppositely positioned end joint surface;

providing the cylinder-head with a first cavity that extends into the cylinder-head from the base joint surface;

providing a base joint seal landing common to the first cavity and the base joint surface, the seal landing having a preselected nominal diameter;

providing a second cavity in communication with the first cavity, the second cavity having a wall of a preselected nominal diameter;

positioning a seal means in the base joint seal landing;

providing an end plate having an end joint surface and positioning the end joint surface adjacent the end joint surface of the cylinder-head;

positioning a valve cover against the end joint surface of the cylinder-head to cover the second cavity of the cylinder-head block;

positioning a seal means between the valve cover and the wall of the second cavity of the cylinder-head; and providing fastener means for securing and forcing the end joint surface of the end plate toward the end joint surface of the cylinder-head to at least a preselected minimum preload, the fastener means being configured and constructed of a selected material having a predetermined yield strength which corresponds to a predetermined maximum operating pressure of the fluid end assembly and in which the yield strength of the fastener means is less than the yield strength of the tie-bolts.

12. The method of claim 11 wherein the nominal internal diameter of the base joint seal landing is less than the nominal diameter of the wall of the second cavity in the cylinder-head.

13. The method of claim 11 wherein the fluid end assembly is a T-bore type arrangement.

14. The method of claim 11 wherein a separate fluid end assembly is provided for each plunger or piston located in a common cylinder housing having more than one such plunger or piston located in respective bores therein.

* * * * *